US006450460B1

(12) United States Patent
Trahan et al.

(10) Patent No.: US 6,450,460 B1
(45) Date of Patent: Sep. 17, 2002

(54) BAG SUPPORT APPARATUS

(76) Inventors: Victor T. Trahan, 589 Gilbert Dr. Northeast, Palm Bay, FL (US) 32907; Linda A. Trahan, 589 Gilbert Dr. Northeast, Palm Bay, FL (US) 32907

( * ) Notice: Subject to any disclaimer, the term of this patent is extended or adjusted under 35 U.S.C. 154(b) by 0 days.

(21) Appl. No.: 09/648,241

(22) Filed: Aug. 25, 2000

(51) Int. Cl.[7] ..... A63B 55/04
(52) U.S. Cl. ..... 248/97
(58) Field of Search ..... 248/97, 99–101, 248/95, 530, 533, 519, 529, 74.1, 156; 383/33, 34, 78; 141/391; 211/96, 85.15, 85, 85.31, 168, 169, 169.1, 170, 173

(56) References Cited

U.S. PATENT DOCUMENTS

| | | | | | |
|---|---|---|---|---|---|
| 646,762 | A | * | 4/1900 | Reser | 248/97 |
| 812,157 | A | * | 2/1906 | Thompson | 248/97 |
| 1,027,464 | A | * | 5/1912 | Dahlstrom | 248/97 |
| 1,350,443 | A | * | 8/1920 | Edstrom | 248/97 |
| 3,642,145 | A | * | 2/1972 | Shelton | 211/85 |
| D227,849 | S | | 7/1973 | Snoddy | |
| 3,866,872 | A | * | 2/1975 | Burgess | 248/97 |
| 4,096,951 | A | * | 6/1978 | Menssen | 211/207 |
| 4,312,489 | A | | 1/1982 | Paezold | |
| 4,319,726 | A | | 3/1982 | Andersson | |
| 4,702,445 | A | | 10/1987 | Ivory | |
| 4,927,104 | A | * | 5/1990 | Miller | 248/97 |
| 4,940,201 | A | * | 7/1990 | Kurth | 248/101 |
| 5,014,944 | A | * | 5/1991 | Malik et al. | 248/99 |
| 5,033,703 | A | * | 7/1991 | Allen, Sr. | 248/97 |
| 5,139,219 | A | | 8/1992 | Navarro | |
| 5,360,189 | A | * | 11/1994 | Hart | 248/97 |
| 5,570,862 | A | * | 11/1996 | Nugent | 248/97 |
| 5,735,494 | A | * | 4/1998 | Kurk | 248/97 |
| 5,738,315 | A | * | 4/1998 | Kent, Jr. | 248/97 |
| 5,765,789 | A | * | 6/1998 | Ryon et al. | 248/97 |
| 5,826,838 | A | * | 10/1998 | Forbes | 248/97 |
| 5,899,419 | A | * | 5/1999 | Ross et al. | 248/97 |
| 6,202,709 | B1 | * | 3/2001 | Wymer | 141/391 |

* cited by examiner

*Primary Examiner*—Daniel P. Stodola
*Assistant Examiner*—Jennifer E. Novosad

(57) ABSTRACT

A bag support apparatus for holding a bag opened to allow a user to fill the bag. The bag support apparatus includes a height adjustable elongate support member being adapted to penetrate a ground; and also includes a ring support assembly securely attached to the height adjustable elongate support member; and further includes a bag support member being pivotally attached to the height adjustable elongate support member and being supported by the ring support members; and also includes bag fastening members being attached to the bag support member.

9 Claims, 2 Drawing Sheets

BAG SUPPORT APPARATUS

BACKGROUND OF THE INVENTION

1. Field of the Invention

The present invention relates to a bag holder and more particularly pertains to a new bag support apparatus for holding a bag opened to allow a user to fill the bag.

2. Description of the Prior Art

The use of a bag holder is known in the prior art. More specifically, a bag holder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,319,726; 4,312,489; 4,940,201; 4,702,445; 5,139,219; and U.S. Patent No. Des. 227,849.

While these devices fulfill their respective, particular objectives and requirements, the aforementioned patents do not disclose a new bag support apparatus. The inventive device includes a height adjustable elongate support member being adapted to penetrate a ground; and also includes a ring support assembly securely attached to the height adjustable elongate support member; and further includes a bag support member being pivotally attached to the height adjustable elongate support member and being supported by the ring support members; and also includes bag fastening members being attached to the bag support member.

In these respects, the bag support apparatus according to the present invention substantially departs from the conventional concepts and designs of the prior art, and in so doing provides an apparatus primarily developed for the purpose of holding a bag opened to allow a user to fill the bag.

SUMMARY OF THE INVENTION

In view of the foregoing disadvantages inherent in the known types of bag holder now present in the prior art, the present invention provides a new bag support apparatus construction wherein the same can be utilized for holding a bag opened to allow a user to fill the bag.

The general purpose of the present invention, which will be described subsequently in greater detail, is to provide a new bag support apparatus which has many of the advantages of the bag holder mentioned heretofore and many novel features that result in a new bag support apparatus which is not anticipated, rendered obvious, suggested, or even implied by any of the prior art bag holder, either alone or in any combination thereof.

To attain this, the present invention generally comprises a height adjustable elongate support member being adapted to penetrate a ground; and also includes a ring support assembly securely attached to the height adjustable elongate support member; and further includes a bag support member being pivotally attached to the height adjustable elongate support member and being supported by the ring support members; and also includes bag fastening members being attached to the bag support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new bag support apparatus which has many of the advantages of the bag holder mentioned heretofore and many novel features that result in a new bag support apparatus which is not anticipated, rendered obvious, suggested, or even implied by any of the prior art bag holder, either alone or in any combination thereof.

It is another object of the present invention to provide a new bag support apparatus which may be easily and efficiently manufactured and marketed.

It is a further object of the present invention to provide a new bag support apparatus which is of a durable and reliable construction.

An even further object of the present invention is to provide a new bag support apparatus which is susceptible of a low cost of manufacture with regard to both materials and labor, and which accordingly is then susceptible of low prices of sale to the consuming public, thereby making such bag support apparatus economically available to the buying public.

Still yet another object of the present invention is to provide a new bag support apparatus which provides in the apparatuses and methods of the prior art some of the advantages thereof, while simultaneously overcoming some of the disadvantages normally associated therewith.

Still another object of the present invention is to provide a new bag support apparatus for holding a bag opened to allow a user to fill the bag.

Yet another object of the present invention is to provide a new bag support apparatus which includes a height adjustable elongate support member being adapted to penetrate a ground; and also includes a ring support assembly securely attached to the height adjustable elongate support member; and further includes a bag support member being pivotally attached to the height adjustable elongate support member and being supported by the ring support members; and also includes bag fastening members being attached to the bag support member.

Still yet another object of the present invention is to provide a new bag support apparatus that is easy and convenient to use for opening and supporting a bag to be filled with debris.

Even still another object of the present invention is to provide a new bag support apparatus that is collapsible and easy to carry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS.

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
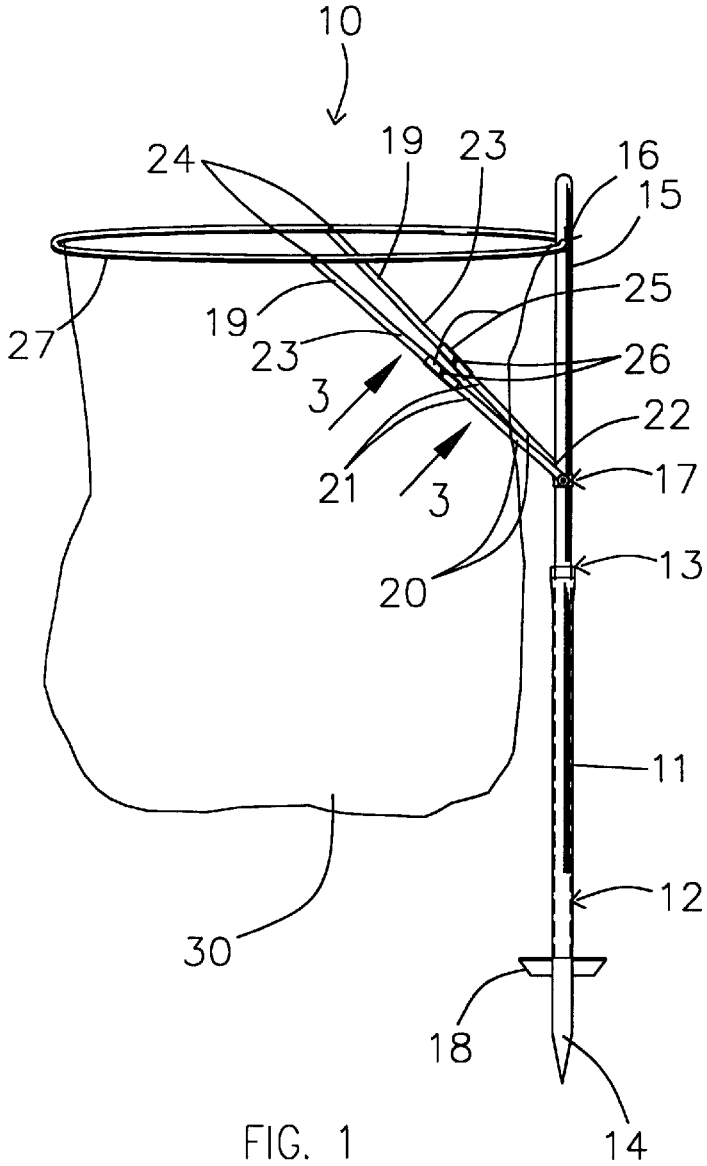
FIG. 1 is a side elevational view of a new bag support apparatus according to the present invention.
Figure 2:
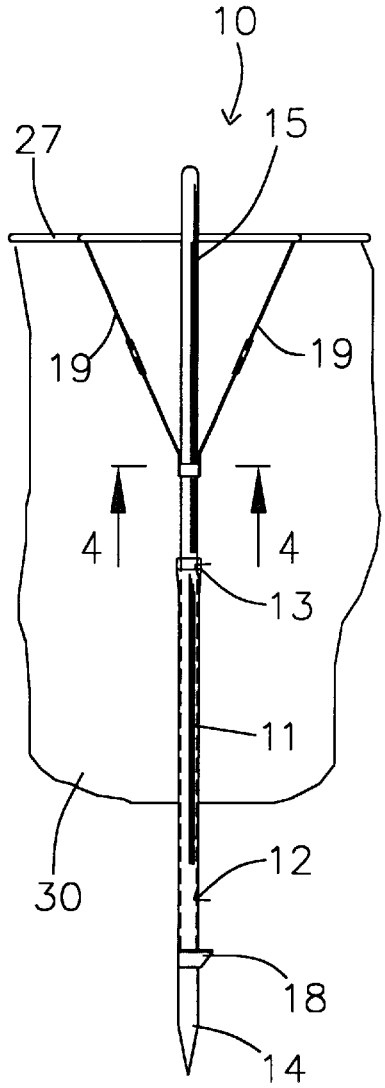
FIG. 2 is a rear elevational view of the present invention.
Figure 5:
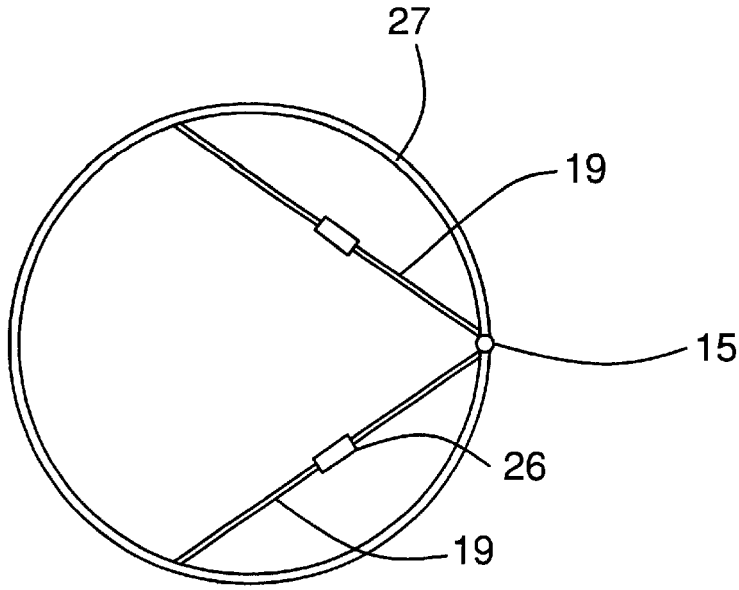
FIG. 5 is a top plan view of the present invention.
Figure 3:
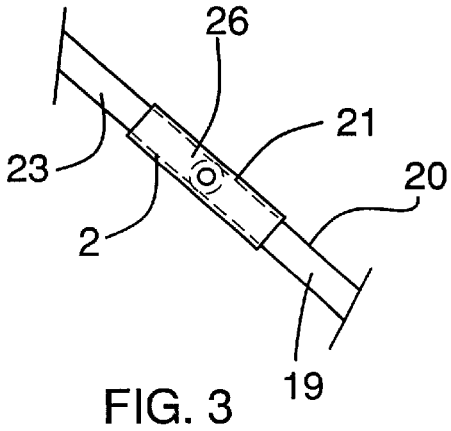
FIG. 3 is a detailed side elevational view of one of the ring support members and a fastener of the present invention.
Figure 4:
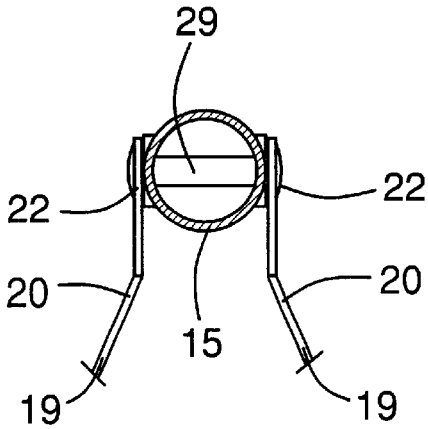
FIG. 4 is a cross-sectional view of the shaft showing the pivot member of the present invention.
Figure 6:
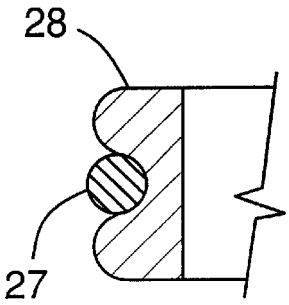
FIG. 6 is a cross-sectional view of the ring showing one of the fastening members of the present invention.

With reference now to the drawings, and in particular to FIGS. 1 through 6 thereof, a new bag support apparatus embodying the principles and concepts of the present invention and generally designated by the reference numeral 10 will be described.

As best illustrated in FIGS. 1 through 6, the bag support apparatus 10 generally comprises a height adjustable elongate support member being adapted to penetrate a ground with the height adjustable elongate support member including a tubular base member 11 having a tapered bottom end 14 for easy penetration into the ground and also having an open top end 13 and a bore 12 extending therein, and also including a shaft 15 being movably disposed in and extendable from the tubular base member 11 through the open top end 13 of the tubular base member 11, and further including a foot step member 18 being securely and conventionally attached to the tubular base member 11 near the bottom end 14 thereof for a user to step upon to drive the tubular base member 11 into the ground. The shaft 15 includes holes 16,17 disposed through side walls thereof with a first 16 of the holes being disposed near a top end of the shaft 15 and with a second 17 of the holes being disposed near a bottom end of the shaft 15. The height adjustable elongate support member is adjustable to heights of approximately 3 to 4 feet.

A ring support assembly is securely and conventionally attached to the height adjustable elongate support member with the ring support assembly including a pivot member 29 being disposed through the second hole 17 and also including a pair of ring support members 19 each including a first linkage member 20 having a first end 21 and a second end 22 which is conventionally mounted to the pivot member 29, and each also including a second linkage member 23 having a first end and also having a second end 25 which is pivotally and fastenably connected with a fastener 26 to the first end 21 of the first linkage member 20.

A bag support member 27 is pivotally attached to the height adjustable elongate support member and is pivotally and conventionally connected to the first ends 24 of the second linkage members 23 with the bag support member 27 being essentially a ring 27 being extended through the first hole 16. The ring 27 has a diameter of approximately 24 inches. Bag fastening members 28 are conventionally attached to the bag support member 27 with the bag fastening members 28 including clip members being spaced apart and being depended from the ring 27 for clipping onto a bag 30. The clip members 28 are essentially shaped like horseshoes.

In use, the user uses one's foot to step on the foot step 18 to insert the tubular base member 11 into the ground and then extends the shaft 15 to a desirable height and then pivots the ring 27 to a horizontal position and then secures the ring 27 with the linkage members 20,23 and then attaches a bag 30 to the clip members 28 to allow the user to fill the bag 30 with debris as desired by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bag support apparatus comprising:

a height adjustable elongate support member being adapted to penetrate a ground;

a ring support assembly securely attached to said height adjustable elongate support member;

a bag support member being pivotally attached to said height adjustable elongate support member and being supported by said ring support assembly; and bag fastening members being attached to said bag support member;

wherein said ring support assembly includes a pivot member being pivotally mounted on said height adjustable elongate support member, said ring support assembly including a pair of ring support members, each of said ring support members including a first linkage member having a first end and a second end with said second end being mounted to said pivot member, said ring support members including a second linkage member having a first end pivotally connected to said bag support member and a second end pivotally connected to said first end of said first linkage member;

wherein said height adjustable elongate support member includes a tubular base member having a tapered bottom end for penetration into the ground and also having an open top end and a bore extending therein, and also includes a shaft being movably disposed in and extendable from said tubular base member through said open top end of said tubular base member, and further includes a foot step member attached to said tubular base member near said bottom end thereof for a user to step upon to drive said tubular base member into the ground; and wherein said shaft includes holes disposed through side walls thereof, a first of said holes being disposed near a top end of said shaft and a second of said holes being disposed near a bottom end of said shaft, said pivot member being disposed through said second hole of said shaft.

2. A bag support assembly as described in claim 1, wherein said bag support member comprises a ring being extended through said first hole.

3. A bag support assembly as described in claim 2, wherein said bag fastening members include clip members being spaced apart and being mounted on said ring for clipping onto a bag.

4. A bag support assembly as described in claim 3, wherein said clip members define a channel.

5. A bag support assembly comprising:

a height adjustable elongate support member being adapted to penetrate a ground;

a ring support assembly securely attached to said height adjustable elongate support member;

a bag support member being pivotally attached to said height adjustable elongate support member and being supported by said ring support assembly; and bag fastening members being attached to said bag support member;

wherein said height adjustable elongate support member includes a tubular base member having a tapered bottom end for easy penetration into the ground and also having an open top end and a bore extending therein, and also includes a shaft being movably disposed in and extendable from said tubular base member through said open top end of said tubular base member, and further includes a foot step member securely attached to said tubular base member near said bottom end thereof for a user to step upon to drive said tubular base member into the ground;

wherein said shaft includes holes disposed through side walls thereof, a first of said holes being disposed near a top end of said shaft and a second of said holes being disposed near a bottom end of said shaft; and wherein said ring support assembly includes a pivot member being disposed through said second hole and also includes a pair of ring support members each including a first linkage member having a first end and a second end which is mounted to said pivot member, and each also including a second linkage member having a first end which is pivotally connected to said bag support member and also having a second end which is pivotally and fastenably connected with a fastener to said first end of said first linkage member.

6. A bag support assembly as described in claim 5, wherein said bag support member comprises a ring being extended through said first hole.

7. A bag support assembly as described in claim 6, wherein said bag fastening members include clip members being spaced apart and being mounted on said ring for clipping onto a bag.

8. A bag support assembly as described in claim 7, wherein said clip members define a channel.

9. A bag support apparatus comprising:

a height adjustable elongate support member being adapted to penetrate a ground, said height adjustable elongate support member including a tubular base member having a tapered bottom end for penetration into the ground and also having an open top end and a bore extending therein, and also including a shaft being movably disposed in and extendable from said tubular base member through said open top end of said tubular base member, and further including a foot step member securely attached to said tubular base member near said bottom end thereof for a user to step upon to drive said tubular base member into the ground, said shaft including holes disposed through side walls thereof, a first of said holes being disposed near a top end of said shaft and a second of said holes being disposed near a bottom end of said shaft;

a ring support assembly securely attached to said height adjustable elongate support member, said ring support assembly including a pivot member being disposed through said second hole and also includes a pair of ring support members each including a first linkage member having a first end and a second end which is mounted to said pivot member, and each also including a second linkage member having a first end and also having a second end which is pivotally and fastenably connected with a fastener to said first end of said first linkage member;

a bag support member being pivotally attached to said height adjustable elongate support member and being pivotally attached to said first ends of said second linkage members, said bag support member being essentially a ring being extended through said first hole, said ring having a diameter of approximately 24 inches; and bag fastening members being attached to said bag support member, said bag fastening members including clip members being spaced apart and being mounted on said ring for clipping onto a bag, said clip members define a channel.

* * * * *